United States Patent [19]

Ferrigno

[11] Patent Number: 4,718,348

[45] Date of Patent: Jan. 12, 1988

[54] GROOVED PROJECTILES

[76] Inventor: John E. Ferrigno, 925 E. Magnolia, Apt. Q-2, Tallahassee, Fla. 32301

[21] Appl. No.: 863,788

[22] Filed: May 16, 1986

[51] Int. Cl.[4] ..... F42B 11/00

[52] U.S. Cl. ..... 102/439; 102/501; 244/3.23

[58] Field of Search ..... 102/430, 438, 439, 501, 102/520–523; 244/3.23

[56] References Cited

U.S. PATENT DOCUMENTS

| | | | |
|---|---|---|---|
| 27,795 | 10/1859 | Abbott . | |
| D. 271609 | 11/1983 | Brown . | |
| 484,008 | 10/1892 | Haskell . | |
| 686,637 | 11/1901 | Robertson . | |
| 871,825 | 11/1907 | Schupmann . | |
| 1,181,849 | 5/1916 | Coomber | 244/3.23 |
| 1,323,532 | 12/1919 | Hoar . | |
| 1,518,920 | 12/1924 | Halloran | 102/501 |
| 2,306,140 | 12/1942 | Reed | 102/522 |
| 3,412,681 | 11/1968 | Schirneker | 102/438 |
| 3,726,231 | 4/1973 | Kelly et al. | 102/522 |
| 3,877,381 | 4/1975 | McCoy | 102/448 |

FOREIGN PATENT DOCUMENTS

| | | | |
|---|---|---|---|
| 472147 | 11/1914 | France | 244/3.23 |
| 215686 | 10/1941 | Switzerland | 102/438 |

*Primary Examiner*—Harold Tudor

*Attorney, Agent, or Firm*—Fleit, Jacobson, Cohn & Price

[57] ABSTRACT

Projectiles for use in shells for shotguns and other smooth bore weapons are teardrop-shaped having a blunt hemispherical nose portion and an elongate tail portion tapering smoothly from a junction with the nose portion to a relatively sharp tip. The outer surface of the nose portion is provided with radiating curved grooves for imparting in-flight spin to the projectile so as to stabilize it in flight. The projectiles may be used in a shell case singly to provide a relatively large caliber slug or alternatively small caliber projectiles may be used in elongate stacks in a shell case to provide a form of buckshot.

2 Claims, 8 Drawing Figures

GROOVED PROJECTILES

BACKGROUND AND SUMMARY OF THE INVENTION

This invention relates to projectiles particularly for use in shells for shotguns and other smooth bore weapons.

Conventional buckshot and slugs of the type used in shotguns and the like have no means of stabilization and are accordingly erratic in flight and somewhat short ranged. It is accordingly an object of the present invention to provide an improved form of projectile for use in shotguns and the like which is stabilized in flight over a longer range than conventional shot thereby providing a more effective dispersion pattern.

Projectiles in accordance with the invention are substantially teardrop-shaped having a relatively blunt, substantially hemispherical nose portion, and an elongate tail portion tapering smoothly from a junction with the nose portion to a relatively sharp tip. Preferably, the projectile is provided with grooves in an outer surface of the nose portion radiating from a central location on the nose portion in curved manner substantially to the junction with the tail portion for imparting a stabilizing, in-flight spin to the projectile about an axis connecting the central location and the tip.

Projectiles in accordance with the invention may be used either singly in a shell case as a slug or in multiple configuration as buckshot. In the latter case, the projectiles are preferably stacked on end in one or more columns in the shell case and for this purpose, preferably the projectile has a recess in the nose which receives the tip at a tail end of the preceding projectile.

In use, the grooves, in the form of turbo grooves spin the projectile in flight and being on the projectile's nose portion, the grooves are substantially impervious to damage. The teardrop shape of the projectile has several advantages over the round ball and conical type slug notably in the reduction of drag and improved ballistic coefficient. Further, the teardrop shape moves the center of mass of the projectile forward closer to the force of the spin generated by the turbo grooves, thereby substantially eliminating tumbling experienced with conical slugs. The spinning tear drop shape acts as a flying body, climbing in flight, which increases the range.

For use as a single slug-type projectile in a shell case, the teardrop-shaped slug is preferably centered in the case by use of a sabot with a cavity which conforms to the shape of the slug rearwardly of the grooves. The sabot aligns the axis of the slug with the center of the case and allows for a subcaliber slug producing greater velocity due to drag reduction.

In the multiple shot configuration, the projectiles fit together in a stack or stacks with the tail of the forward projetiles fitting into the recesses of the projectiles behind. This arrangement aligns the shot along a common axis and upon firing the projectiles separate after leaving the firearm barrel. As many as nine 0.30 caliber projectiles or twelve 0.28 caliber projectiles may be fired in this manner in three or four stacks of three projectiles per stack.

A single 12 gauge slug in accordance with the invention may weigh about 1 oz. and is 0.54 caliber. A 20 gauge slug is about ¾ oz. and 0.45 caliber while a 0.30 caliber shot is ⅛ oz. in weight.

It is found in practice that four turbo grooves are sufficient to spin a projectile, the grooves being deep enough to engage the air in order to provide effective spin. When positioning projectiles in a shell, the recess in the center can be used to seat the projectile without deforming the grooves.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
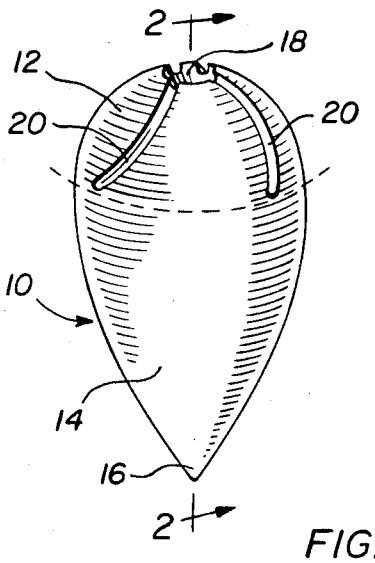
FIG. 1 is a elevational view of a projectile in accordance with the invention.
Figure 2:
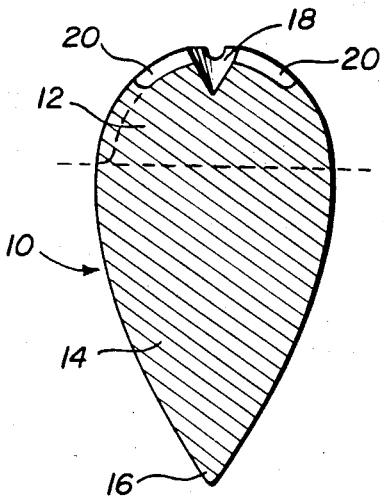
FIG. 2 is a sectional view on line 2—2 of FIG. 1.
Figure 3:
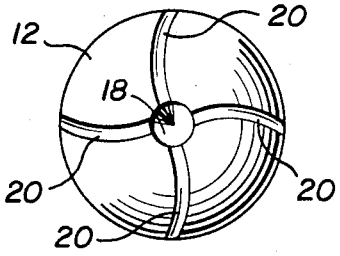
FIG. 3 is a plan view of the projectile.

Referring initially to FIGS. 1–3, there is illustrated a projectile in accordance with the invention which may be in the form of a lead casting or the like, the projectile 10 comprising a relatively blunt substantially hemispherical nose portion 12 and an elongate tail portion 14 tapering smoothly from the nose portion to a relatively sharp tip 16 so that the overall appearance of the projectile is substantially teardrop-shaped. An imaginary junction between nose portion 12 and tail portion 14 is indicated in dotted line in FIGS. 1 and 2.

The center of the nose portion is provided with a recess 18 the shape of which corresponds substantially to the shape of tip 16 so that projectiles may be stacked as will be described hereinafter. Further, radiating from recess 18 are a series of curved surface grooves 20 which extend substantially to the junction between the nose and tail portions of the projectile. In the illustrated embodiment, there are four grooves but this number can be varied. As previously described, the purpose of the grooves is to impart spin to the projectile in flight.

Figure 4:
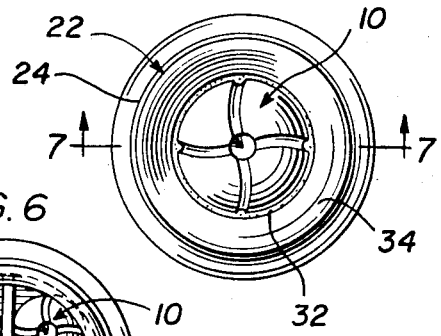
FIG. 4 is a plan view from the front of a first form of shotgun shell including a projectile in accordance with the invention.
Figure 7:
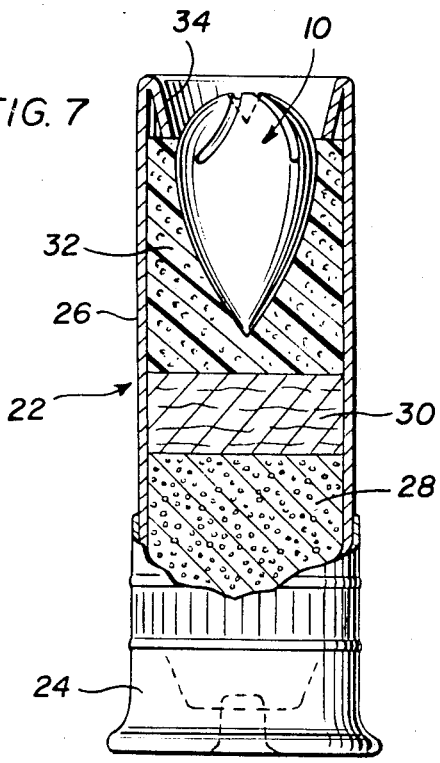
FIG. 7 is a sectional view on line 7—7 of FIG. 4.

Projectiles in accordance with the invention may be used as a single slug in a shotgun or like shell 22 as shown in FIGS. 4 and 7. Shell 22 may have a conventional cap 24, shell case 26, powder 28, wad 30 and primer cap or like initiator (not shown). Slug 10 may be housed in a plastic or like sabot 32 at the forward end of case 26, the sabot and slug being retained by a forward case crimp 34. Preferably, the sabot extends at least to just beyond the junction of the tail and nose portions of the projectile so as to provide adequate retension thereof in the shell prior to firing.

Figure 6:
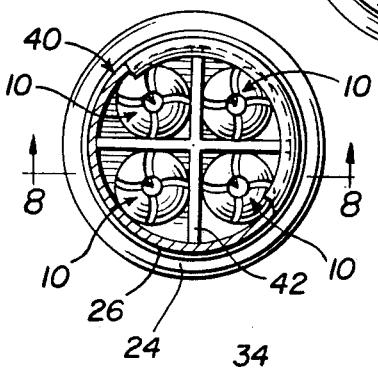
FIG. 6 is a view similar to FIG. 5 showing a different stacking configuration for the projectiles in a shotgun shell.
Figure 8:
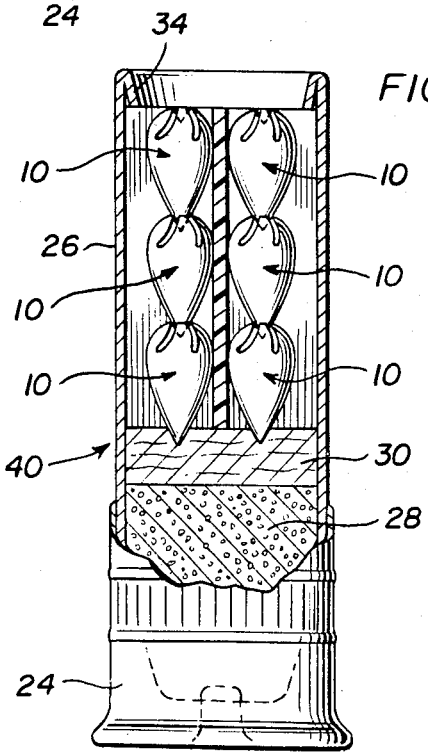
FIG. 8 is a sectional view on line 8—8 of FIG. 7.

In an alternative form of shotgun shell 40 shown in FIGS. 6 and 8 use is made of plural small caliber projectiles 10 in accordance with the invention, the projectiles being arranged in stacked columns between plastic or like partitions 42. In FIGS. 6 and 8, the partitions divide the forward end of the shell case into four elongate compartments each housing a column of three stacked projectiles with the tip 16 of the respective projectiles engaging in the recess 18 of the projectile therebehind. The size of the projectiles is such that they are a snug fit in the respective compartments. The shell is again provided with conventional wadding 30, powder 28, a shell cap 24 and primer or the like not shown. As in the previous embodiment, the projectiles may be retained in the forward end of the shell by a casing crimp 34 or alternatively a forward wad may be used if required.

Figure 5:
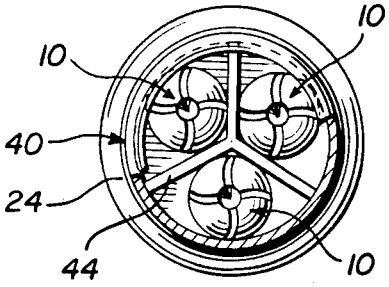
FIG. 5 is a plan view from the front of a further form of shotgun shell including a series of stacked projectiles in accordance with the invention.

FIG. 5 shows an alternative arrangement in which the partitioning 44 divides the shell casing into three compartments for three columns of stacked projectiles 10. The structure is otherwise similar to that shown in FIGS. 6 and 8.

It will be understood that upon firing of the structure shown in FIGS. 6–8, the projectiles remain temporarily in their stacked conditions and are imparted spin by the turbo grooves 20. Eventual dispersion of the respective stacks occurs but the dispersion coefficient is superior to that obtained by conventional shotgun shot. Likewise for the single slug device shown in FIGS. 4 and 7, the turbo grooves are effective in imparting spin to projectile 10 thereby enhancing its accuracy and range.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A shell for use in a shotgun or other smooth bore weapon comprising a shell case including an explosive charge in back of projectile means located in a forward end portion of the case, wherein the projectile means comprises plural individual projectiles arranged in at least one stack extending lengthwise of the case, each projectile being substantially teardrop-shaped having a substantial hemispherical relatively blunt nose portion facing the forward end of the case, an elongate tail portion tapering smoothly from a junction with the nose portion to a relatively sharp tip, and a depression in the nose portion, the projectiles being stacked with the tip of one projectile located in the depression of the projectile therebehind, the projectiles being stacked in plural columns with partition means therebetween forming, in conjunction with the case, elongate compartments snugly receiving the respective columns of stacked projectiles.

2. A shell for use in a shotgun or other smooth bore weapon comprising a shell case including an explosive charge in back of projectile means located in a forward end portion of the case, wherein the projectile means comprises plural individual projectiles arranged in at least one stack extending lengthwise of the case, each projectile being substantially teardrop-shaped having a substantial hemispherical relatively blunt nose portion facing the forward end of the case, an elongate tail portion tapering smoothly from a junction with the nose portion to a relatively sharp tip, and a depression in the nose portion, the projectiles being stacked with the tip of one projectile located in the depression of the projectile therebehind, said shell case including partition means extending radially and longitudinally thereof to form a plurality of elongated compartments, each of said compartments including a stack of projectiles extending lengthwise in end-to-end relation therein, said depression in the nose portion of each projectile being inwardly tapered to closely receive the tapered tip of the tail portion of an adjacent projectile, the nose portion of each projectile including circumferentially spaced curved surface grooves radiating from said depression substantially to the junction of the nose portion with the tail portion to impart spin to the projectile when expelled from the shell case, the transverse cross-sectional area of each projectile at its largest area being substantially equal to the distance between surfaces defining the compartment which engage the projectile whereby the projectiles will be snugly received in the compartments for accurate guidance and stabilization when expelled therefrom, the transverse cross-sectional area of engagement between the tapered tail portion and the depression being substantially less than the largest cross-sectional area of the nose portion and spaced inwardly from the partition means.

* * * * *